United States Patent [19]

Castonguay et al.

[11] 4,301,435

[45] Nov. 17, 1981

[54] FLUX SHIFTER RESET ASSEMBLY

[75] Inventors: Roger N. Castonguay, Terryville; Jon P. McCuin, Bristol, both of Conn.

[73] Assignee: General Electric Company, New York, N.Y.

[21] Appl. No.: 162,280

[22] Filed: Jun. 23, 1980

[51] Int. Cl.[3] ..... H01H 9/20; H01H 73/02; H01H 83/00

[52] U.S. Cl. ..... 335/26; 335/166; 200/153 SC

[58] Field of Search ..... 335/26, 27, 28, 17, 335/20, 166, 167, 168, 169, 170, 171, 172, 173, 174, 175; 200/308, 320, 153 SC, 153 G, 153 H

[56] References Cited

U.S. PATENT DOCUMENTS

| | | | |
|---|---|---|---|
| 4,075,584 | 2/1978 | Castonguay et al. | 335/20 |
| 4,211,989 | 7/1980 | Acampora | 200/308 |
| 4,251,702 | 2/1981 | Castonguay et al. | 200/153 SC |

*Primary Examiner*—Harold Broome

*Attorney, Agent, or Firm*—Richard A. Menelly; Walter C. Bernkopf; Philip L. Schlamp

[57] ABSTRACT

A reset lever is actuated in response to circuit breaker movable contacts swinging from their closed position to their tripped open position to exert a resilient force effective in reseating the plunger of a flux shifting-type trip solenoid. The reset lever also actuates a trip lever into tripping engagement with a circuit breaker trip latch assembly in the event the movable contacts are blown open by a high level fault current.

10 Claims, 7 Drawing Figures

FLUX SHIFTER RESET ASSEMBLY

REFERENCE TO RELATED APPLICATIONS

The instant application is related to the commonly assigned, concurrently filed patent applications entitled Circuit Breaker Trip Latch Assembly (Ser. No. 162,281), Undervoltage Release Reset and Lockout Apparatus (Ser. No. 162,271), Circuit Breaker Electrical Closure Control Apparatus (Ser. No. 162,278), Circuit Breaker Condition Indicator Apparatus (Ser. No. 162,282) and Circuit Breaker Hook Apparatus (Ser. No. 162,279).

BACKGROUND OF THE INVENTION

The present invention relates to industrial circuit breakers and particularly to an assembly for reliably reseating the plunger of a flux-shifter type trip solenoid from its extended position in tripping engagement with a circuit breaker trip latch assembly.

The subject reset assembly has particular, but not necessarily limited application to a store energy, reclosure type circuit breaker, such as that disclosed in commonly assigned, copending application Ser. No. 52,276, filed June 25, 1979 now Pat. No. 4,251,702. The disclosure of this copending application is specifically incorporated herein by reference. As therein disclosed, a circuit breaker is equipped with a separate charging mechanism which is charged and then discharged to charge a spring-powered operating mechanism capable, when charged, to articulate breaker movable contacts from an open position to a closed position and, when discharged or tripped, from their closed to their open position. The charging mechanism also has the capability of being sustained in its charged condition to await subsequent discharge of the operating mechanism, whereupon it automatically discharges to abruptly recharge the operating mechanism. In many cases, the discharge of the operating mechanism is triggered by electrical activation of a flux shifting type trip solenoid in response to an overcurrent condition sensed by a solid state trip unit. Such solenoid activation creates an electromagnetizing flux in opposition to the holding flux of a permanent magnet normally effective in holding the solenoid plunger in its seated position against the bias of a spring. The spring then becomes overpowering, and the plunger is propelled to its extended position where it trippingly engages a trip latch assembly acting to trip or discharge the operating mechanism and thus open the breaker contacts. Since recharging of the operating mechanism by the charging mehcanism can occur very quickly, it is necessary that the solenoid plunger be reset, i.e., reseated, even more quickly in order that the trip latch assembly can reset itself soon enough to hold the charge imparted thereto by the charging mechanism. Otherwise the operating mechanism immediately discharges or 37 crashes" without ever closing the breaker contacts, a situtation detrimental to the operating mechanism.

It is accordingly an object of the present invention to provide an improved flux shifter reset assembly.

A further object is to provide an exceptionally fast acting flux shifter reset assembly of the above character.

Another object is to provide a flux shifter reset assembly of the above character acting in response to the opening movement of the breaker contacts to reseat the plunger of a flux shifter trip solenoid from its trip initiating extended position.

An additional object is to provide a flux shifter reset sytem which is equipped with means to trip the circuit breaker in response to the breaker contacts being blown open by high level fault currents.

Other objects of the invention will in part be obvious and in part appear hereinafter.

SUMMARY OF THE INVENTION

In accordance with the present invention, there is provided flux shifter reset apparatus for reliably resetting the plunger of a flux shifter-type trip solenoid from its circuit breaker trip initiating extended position to its seated position. The apparatus includes a reset lever pivotally mounted for movement between a deactivated position and an actuated position. An elongated actuating arm is pivotally mounted adjacent one end to the reset lever and is resiliently drivingly coupled adjacent its other end to the reset lever. An activating element, carried by the circuit breaker movable contacts, swings into engagement with the actuating arm as the movable contacts spring from their closed position toward their tripped open position incident to the trip solenoid plunger having sprung to its extended position in trip initiating engagement with a trip latch assembly to precipitate discharge of the breaker movable contact operating mechanism. In response to the activating element engagement, the actuating arm and reset lever are swung as a unit about the latter's pivotal mounting, bringing the reset lever to its actuated position where it has engageably reset the trip solenoid plunger to its seated position. With continued actuating engagement of the actuating arm by the activating element, the resilient drive coupling between the actuating arm and the reset lever yields, such as to exert a resilient force on the plunger effective in firmly reseating it. This resilient reseating force is effectuated and maintained essentially constant prior to the movable contacts achieving their tripped open position, thus to insure reliable reseating of the trip solenoid plunger.

As an additional feature of the present invention, a trip lever is picked up and pivoted into tripping engagement with the breaker trip latch assembly by the reset lever as the latter is propelled to its actuated position. If the opening movement of the movable contacts is in response to the electrodynamic forces associated with a high level fault current, i.e., movable contacts being blown open, rather than in response to the trip solenoid plunger having trippingly impacted the trip latch assembly, the trip lever trippingly impacts the trip latch assembly. Thus, in this situation, the operating mechanism is tripped independently of the trip solenoid, precipitating discharge thereof such that it catches up with the opening movement of the movable contacts in time to prevent the movable contacts from momentarily closing back in on the fault.

The invention accordingly comprises the features of construction and arrangement of parts which will be exemplified in the construction hereinafter set forth, and the scope of the invention will be indicated in the claims.

For a better understanding of the nature and objects of the invention, reference should be had to the following detailed description taken in conjunction with the accompanying drawings in which:

DESCRIPTION OF DRAWINGS

Corresponding reference numerals refer to like parts throughout the several views of the drawings.

DETAILED DESCRIPTION

Figure 1:
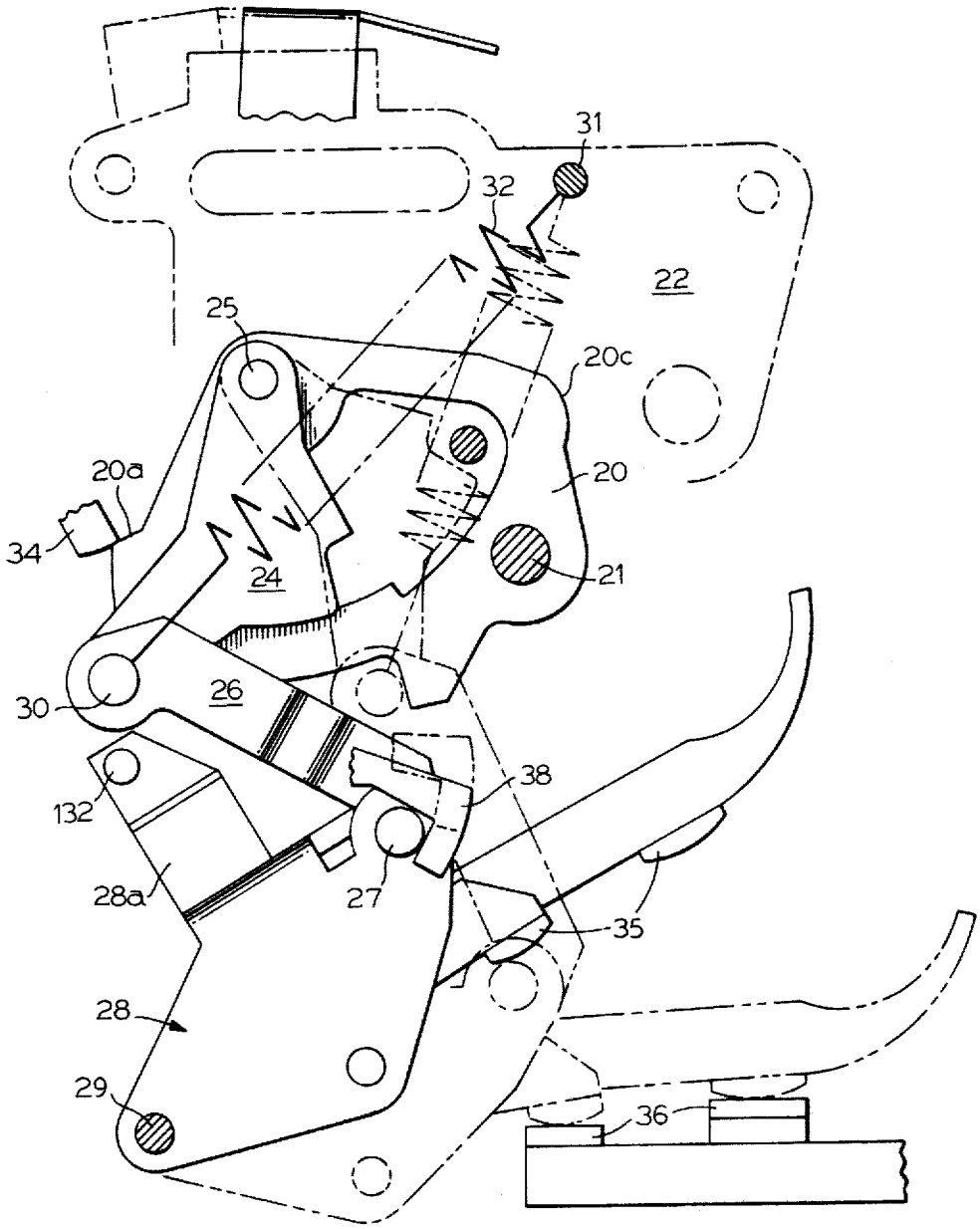
FIG. 1 is a side elevational view of a circuit breaker spring-powered movable contact operating mechanism.

Turning to the drawings, there is shown in FIG. 1, a circuit breaker movable contact operating mechanism corresponding to that disclosed in the above-noted copending application, Ser. No. 52,276. Thus, a cradle 20 is fixedly mounted on a pin 21 journalled by opposed mechanism frame sideplates 22. A toggle linkage consisting of an upper link 24 and a lower link 26 connects cradle 20 to a center pole movable contact assembly 28, pivotally mounted at 29. Specifically, the upper end of link 24 is pivotally connected to the cradle by a pin 25, while the lower end of link 26 is pivotally connected to the center pole movable contact assembly by a pin 27. The other ends of these toggle links are pivotally interconnected by a knee pin 30. Mechanism tension springs 32 act between the toggle knee pin and a stationary pin 31 supported between the frame sideplates 22.

From the description thus far, it will be noted that, by virtue of the position of spring anchoring pin 31, the line of action of the mechanism springs, while in their charged state by virtue of cradle 20 being in its latched reset position sustained by the engagement of a latch 34 with cradle latch shoulder 20*a*, is always situated to the right of the upper toggle link pivot pin 25. Thus, the mechanism springs continuously act to straighten the toggle. Since straightening of the toggle forces the movable contact assemblies 28, ganged together by crossbar 28*a*, to pivot downwardly to their phantom line, closed circuit position with their movable contacts 35 engaging stationary contacts 36, the circuit breaker is always biased toward contact closure while cradle 20 is latched in its reset position.

To control the moment of contact closure, a hook 38 engages pin 27 to hold movable contact assemblies 28 in a hooked open circuit position while the cradle is latched in its reset position and while it is being returned to its latched, reset position from a clockwise-most tripped position to charge the mechanism springs. Thus the toggle is maintained collapsed to the left as seen in FIG. 1. When the hook is removed, the movable contact assemblies 28 are pivoted to their closed circuit positions as springs 32 act to abruptly straighten toggle links 24, 26.

Figure 2:
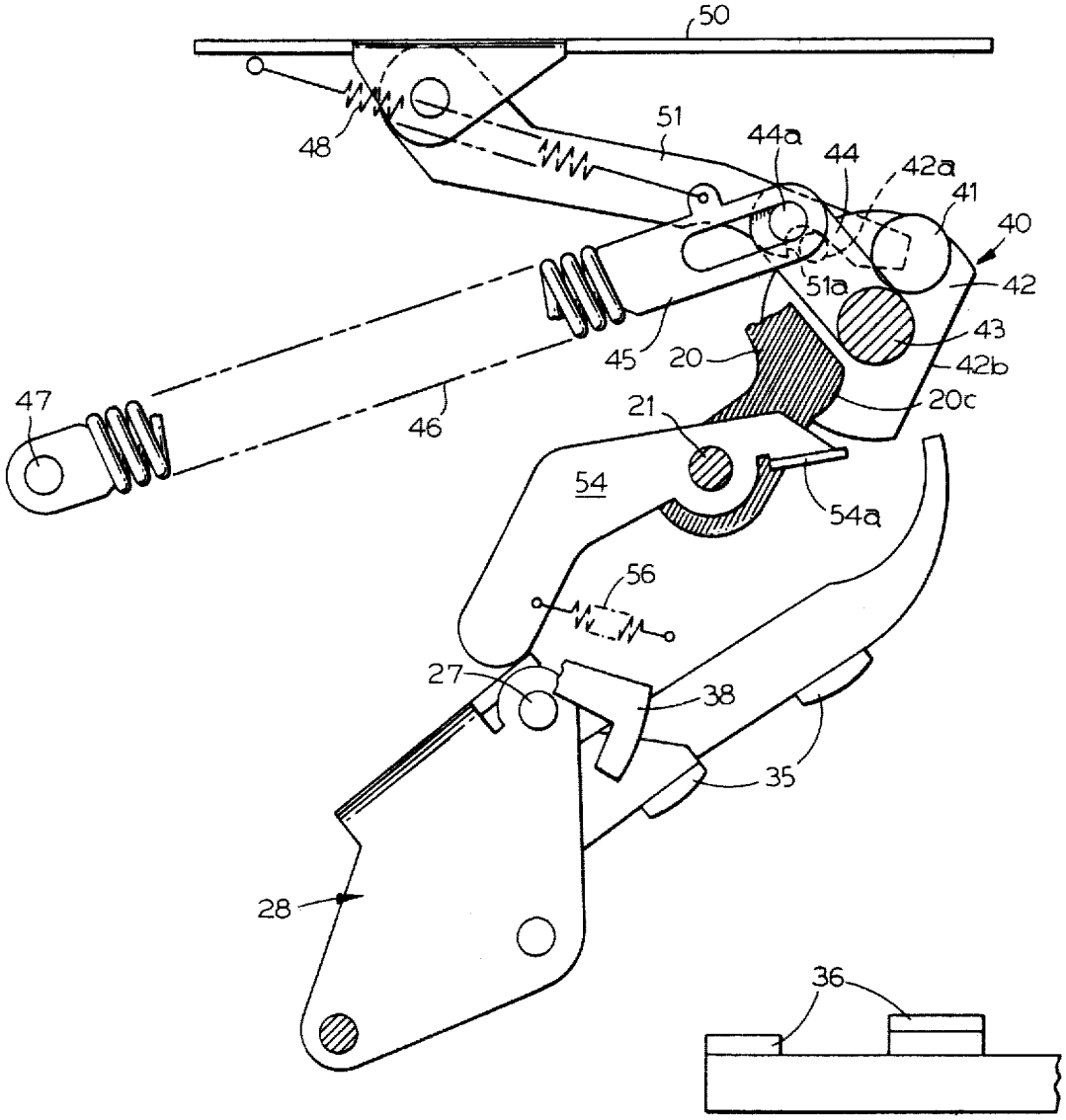
FIG. 2 is a simplified, side elevational view of a spring-powered charging mechanism utilized to charge the movable contact operating mechanism of FIG. 1.
Figure 3:
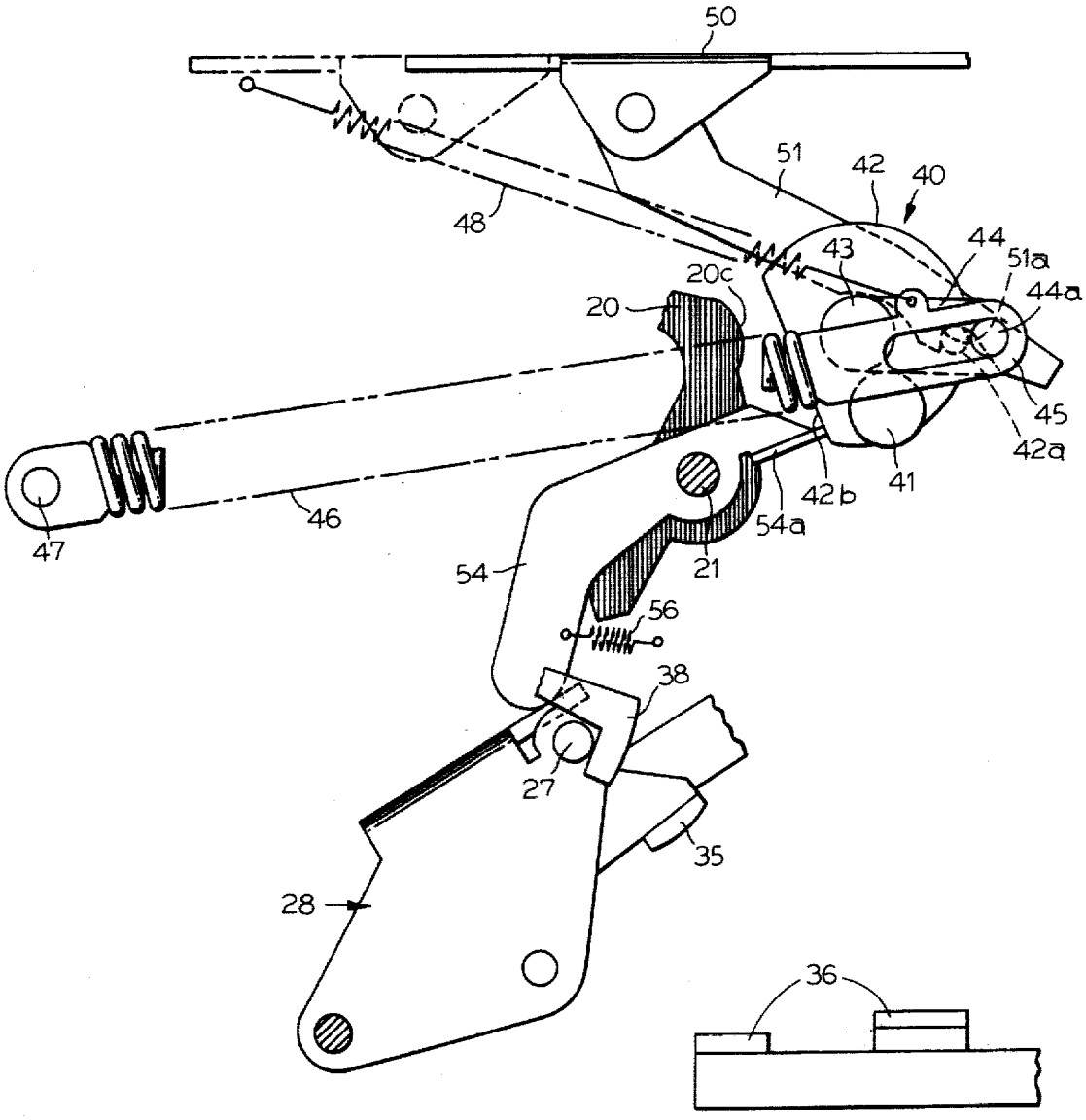
FIG. 3 is a simplified, side elevational view of the charging mechanism of FIG. 2 in its condition with a charge stored therein and while a charge is stored in the movable contact operating mechanism.
Figure 4:
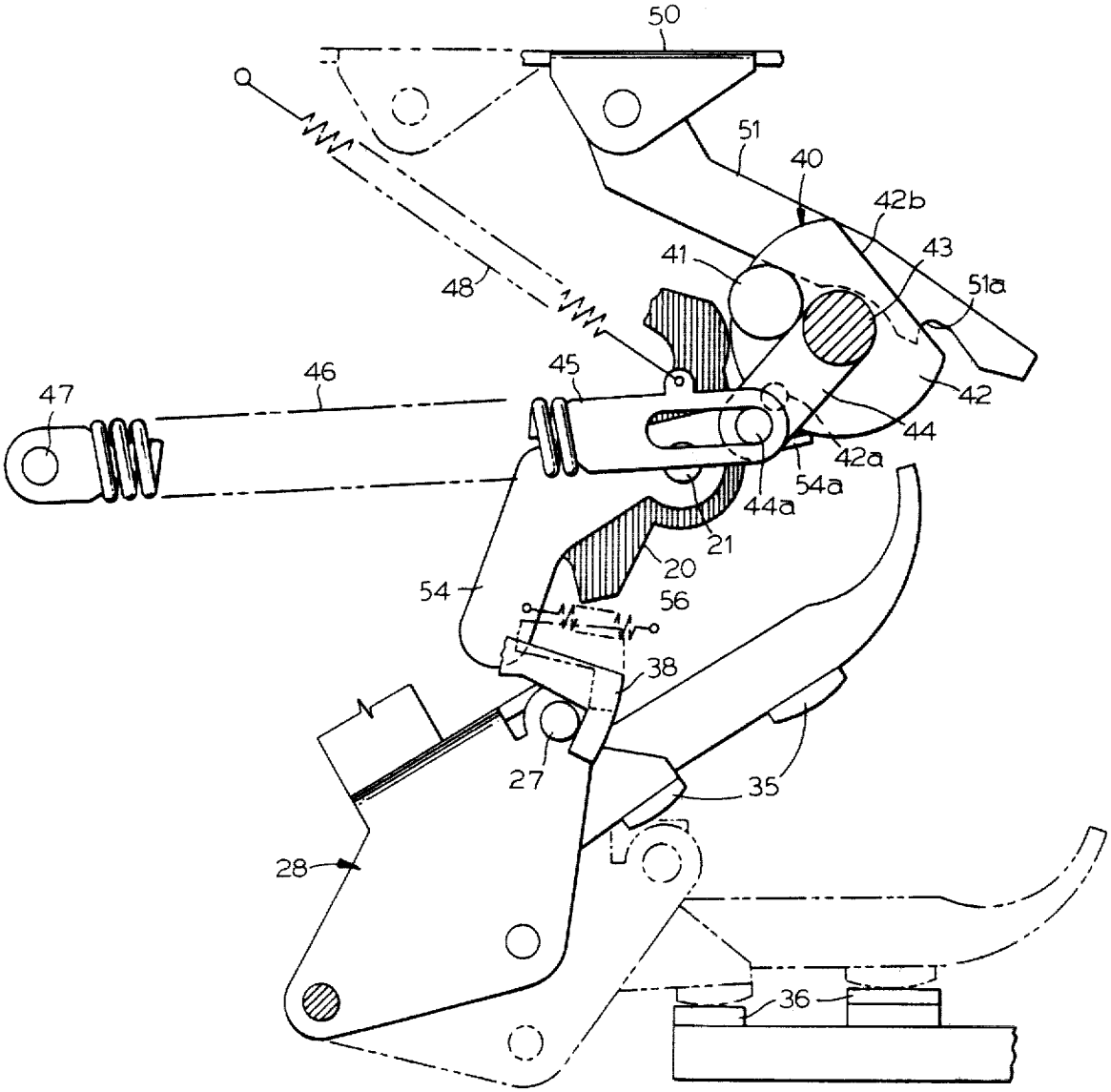
FIG. 4 is a simplified, side elevational view of the charging mechanism seen in its discharged condition while a charge is stored in the movable contact operating mechanism.

Reference is now had to FIGS. 2 through 4 for a review of the overall operation of the circuit breaker disclosed in the above-noted application, Ser. No. 52,276, and specifically the operation of a separate charging mechanism in charging the mechanism springs of the movable contact operating mechanism of FIG. 1. To induce counter-clockwise resetting pivotal movement of cradle 20, a bell crank assembly, generally indicated at 40, is provided with a reset roller 41 eccentrically mounted by a bell crank arm 42 carried by a shaft 43 journalled by the frame sideplates. Keyed to this shaft is an arm 44 which carries at its free end a pin 44*a* operating in an elongated slot in a spring anchor 45 secured to one end of a powerful tension spring 46. The other end of this spring is anchored to a stationary pin 47. As will be seen, when charging spring 46 discharges, bell crank assembly 40 is rotated clockwise to swing the reset roller around to engage a nose 20*c* of cradle 20, while in its tripped position, thereby driving the cradle in the counterclockwise direction to its latched reset position, in the process charging the contact operating mechanism springs 32 (FIG. 1).

Referring first to FIG. 2, bell crank assembly 40 is seen in its start angular orientation achieved by the action of a tension spring 48. An operator slide 50 is shown in its left-most return position with a pawl 51, pivotally connected thereto, retracted to a position where a notch 51*a* in its free end is in intercepting relation with an eccentric pin 42*a* carried by crank arm 42. From FIG. 3 it is seen that when slide 50 is propelled to the right through a breaker operating mechanism charging stroke, drive pawl 51 is pushed to the right. Its notch 51*a* picks up pin 42*a*, causing bell crank assembly 40 to be rotated in the clockwise direction. When the bell crank assembly reaches its angular position of FIG. 3, it is seen that charging spring 46 is stretched to a charged state. It is assumed, at this point in the description, that the movable contact operating mechanism of FIG. 1 is tripped, and thus cradle 20 is in its clockwise-most tripped position seen in FIG. 2. Under these circumstances, the essentially discharged contact operating mechanism springs 32 have lifted movable contact assemblies 28, to a counterclockwise-most tripped open position also seen in FIG. 2. In this position, the top surface of the center pole movable contact assembly engages and lifts the left lower end of a prop 54 pivotally mounted intermediate its ends by cradle pin 21. The upper end 54*a* of this prop is moved downwardly out of engaging relation with the arcuate surface portion of the bell crank arm against which it is normally engaged under the bias of a return spring 56.

As seen in FIG. 3, the rightward charging stroke of operator slide 50 is sufficient to carry the line of action of charging spring 46 through the axis of the bell crank assembly shaft 43. Consequently, with prop 54 in its FIG. 2 position, the charging spring immediately discharges and the bell crank assembly is thereby driven into the clockwise direction, swinging reset roller 41 into engagement with nose 20*c* of cradle 20 in its tripped position of FIG. 2. The cradle is thus swung in the counterclockwise direction to its reset position as the discharging springs 46 drive the bell crank assembly to its angular position seen in FIG. 4. As cradle 20 is being reset, contact operating mechanism springs 32 are charged to exert a bias tending to drive the movable contact assemblies 28 to their closed circuit positions seen in phantom in FIGS. 1 and 4. However, hook 38 is in position to intercept pin 27 and detain the movable contact assemblies in their hooked open position seen in FIGS. 3 and 4. By virtue of the loss motion coupling between bell crank assembly 40 and charging spring 46 afforded by the slot in spring anchor 45, spring 48 acts to continue the clockwise rotation of the bell crank assembly from its angular position of FIG. 4 around to its start position of FIG. 2 with pin 44*a* again bottomed against the right end of the spring anchor slot.

From the description thus far, it is seen that the first charge-discharge cycle of charging spring 46 has been effective in returning the contact operating mechanism cradle 20 to its latched reset position and charge springs 32 thereof, but the breaker contacts are sustained in their open circuit position by hook 38. At this point, the operator slide 50 can be motivated through a second rightward charging stroke to again charge spring 46. Since movable contact assemblies 28, in their hooked open position, have released prop 54, its upper end 54*a* rides on the arcuate surface portion of bell crank arm 42 as the bell crank assembly is rotated in a clockwise direction. Spring 56 elevates prop end 54*a* into intercepting relation with a flattened surface 42*b* of bell crank arm 42 at the conclusion of the operator slide charging stroke just as the line of action of the charging spring 46 passed below the axis of bell crank assembly shaft 43. Thus, as seen in FIG. 3, prop 54 serves to prevent further clockwise rotation of bell crank assembly 40, and the charging spring 46 is held in a fully charged condition. It is thus seen that while the braker contacts are held in their hooked open circuit position by hook 38, both the charging spring 46 and contact operating mechanism springs 32 are poised in their fully charged conditions. At this point, hook 38 may be articulated to release the movable contact assemblies 28, whereupon they pivot to their closed circuit position under the urgence of mechanism springs 32. It will be noted that closure of the movable contacts has no effect on prop 54, and thus charging spring 46 is sustained in its fully charged condition.

When the cicuit breaker is eventually tripped open by removal of latch 34 (FIG. 1), the unlatched cradle 20 swings clockwise to its tripped position, and the movable contact assemblies abruptly pivot upwardly to their tripped open position of FIG. 2, all under the urgence of the discharging contact operating mechanism springs 32. As the center pole movable contact assembly moves to its tripped open position, it picks up the lower end of prop 54, ducking its upper end out of engagement with the flat peripheral surface 42*b* of crank arm 42. The clockwise rotational restraint on the bell crank assembly is thus removed, and charging spring 46 abruptly discharges, swinging reset roller 41 around to drive cradle 20 from its tripped position of FIG. 2 back to its reset position of FIG. 3. The contact operating mechanism springs 32 are again charged, and the movable contact assemblies 28 move to their hooked open position seen in FIG. 4. At this point, the charging spring 46 may again be charged to create the condition depicted in FIG. 3, and the charge therein will be automatically stored by prop 54 until needed to recharge the contact operating mechanism springs 32. Alternatively, and more significantly, hook 38 may be articulated to precipitate closure of the breaker, and thereafter the breaker may be tripped open without charging the charging spring 46.

From the foregoing description, it is seen that with the breaker contacts open and its contact operating mechanism tripped, the charging spring can be put through a first charge-discharge cycle to charge the contact operating mechanism springs 32 and then a second charge which is stored by prop 54 until needed to re-charge the mechanism springs. Thus, the circuit breaker, starting in its tripped open condition and with two chargings of charging spring 47, can be, in sequence, closed, tripped open, reclosed and tripped open again without an intervening charging of the charging spring. It follows from this that the charging spring can be charged with the breaker contacts closed to achieve, in sequence, opening, closing and opening operations of the circuit breaker without an intervening charge.

Figure 5:
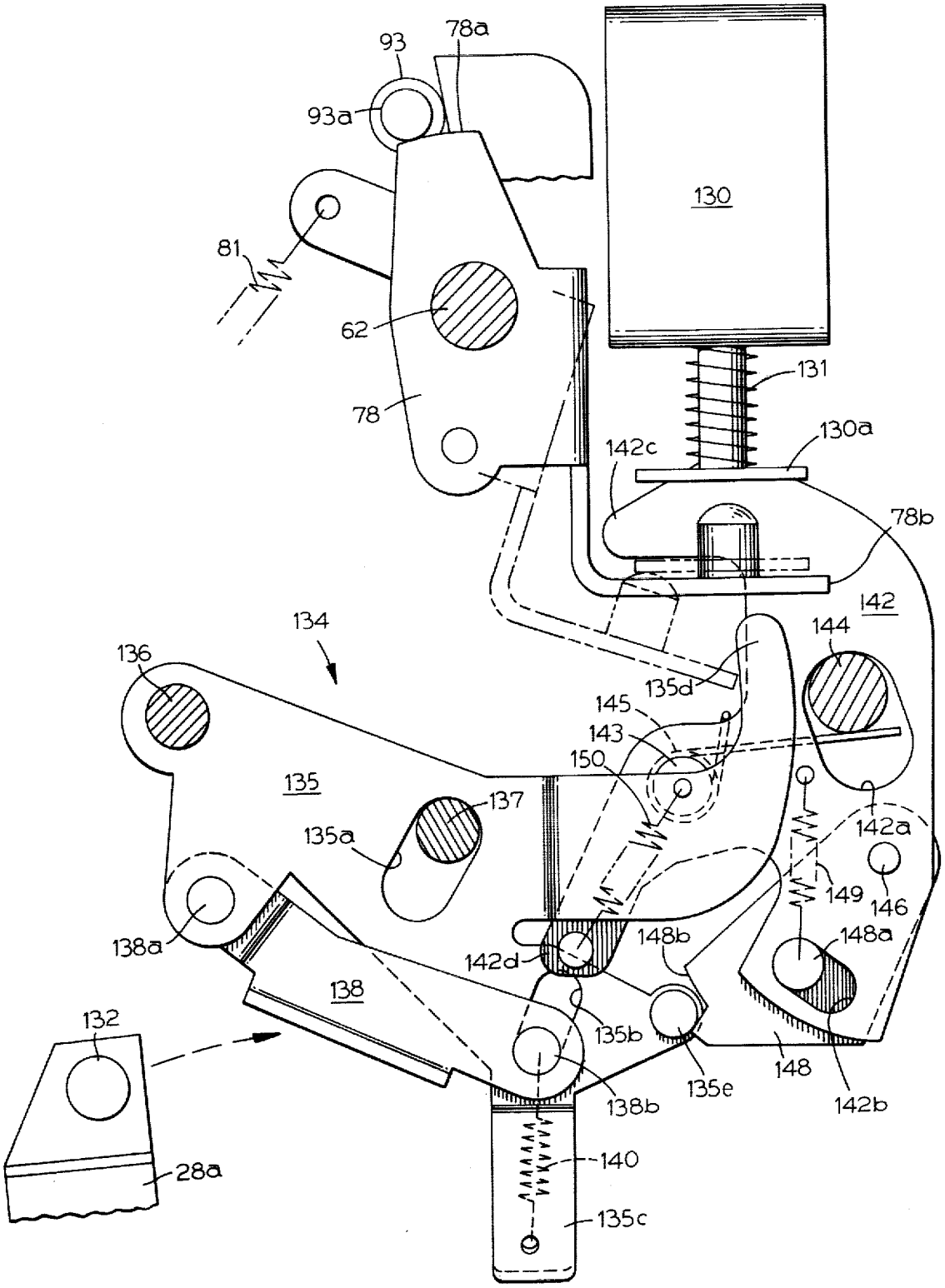
FIG. 5 is a side elevational view of a reset assembly for reseating the plunger of a trip solenoid as seen in its unactuated condition.
Figure 6:
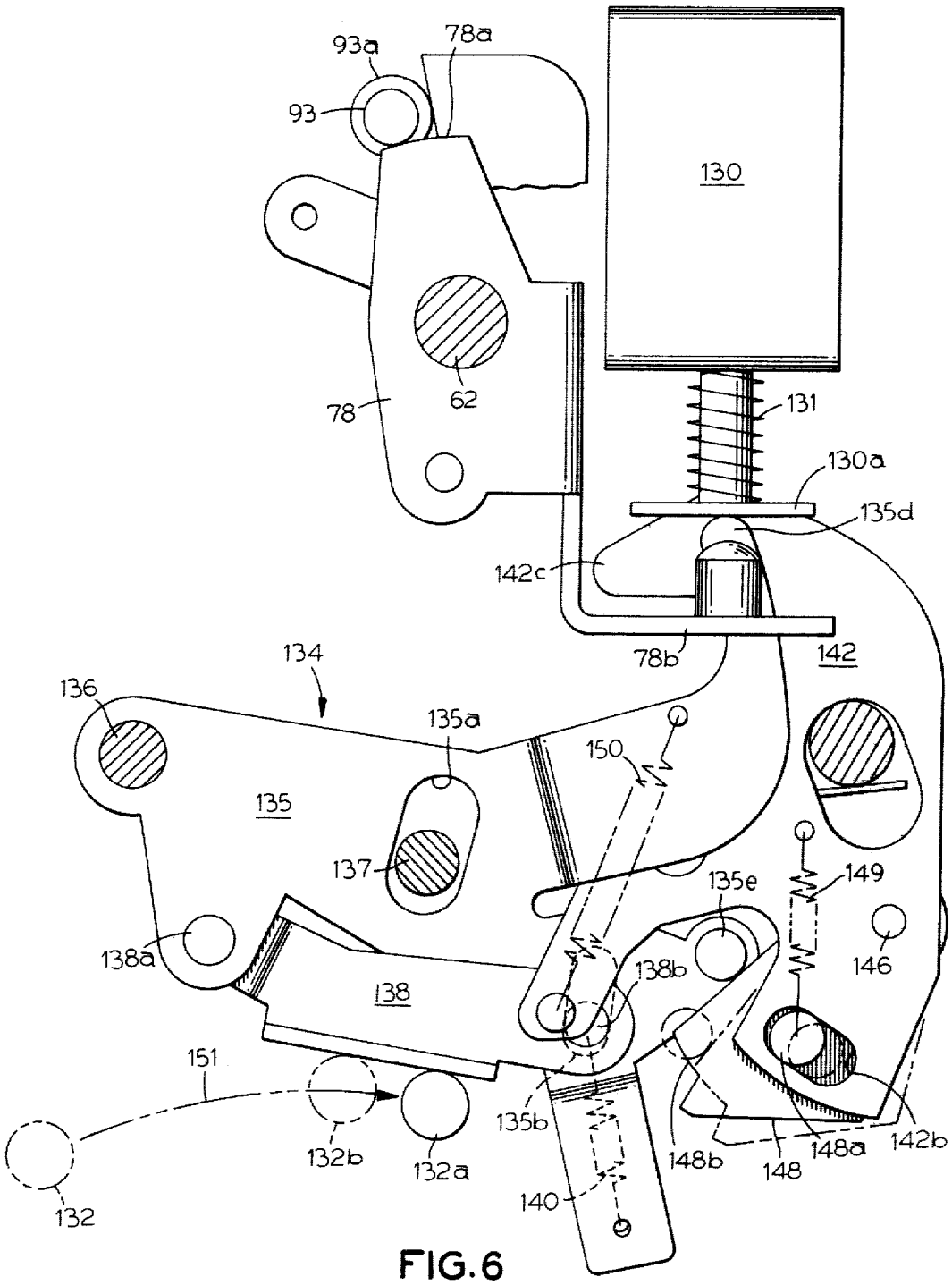
FIG. 6 is a side elevational view of the reset assembly of FIG. 5 as seen in its actuated condition effective in reseating the trip solenoid plunger.

FIG. 5 depicts at 130 a flux shifting-type trip solenoid which is pulsed by a static trip unit (not shown) to trip the circuit breaker automatically in response to a sensed overcurrent condition. Specifically, when the trip solenoid coil is energized, the resulting electromagnetic flux opposes the permanent magnet holding flux normally holding the solenoid plunger 130*a* in its seated, retracted position against the bias of spring 131. The effective holding flux is thus reduced sufficiently to render spring 131 overpowering, and the plunger springs to its phamtom line extended position. In the process, the plunger strikes actuating arm 78*b* of secondary latch 78, and prop 78*a* thereof is swung to its unlatching position out from under extension 93*a* of intermediate latch pin 93. As disclosed in the above-noted related application entitled Circuit Breaker Trip Latch Assembly, this action frees the trip latch assembly to swing primary latch element 34 off of cradle shoulder 20*a* (FIG. 1), and the breaker is tripped open. Since in the subject circuit breaker, resetting of the cradle back to its latched reset position pursuant to recharging its mechanism springs 32 can occur very suddenly and virtually immediately if the breaker has been tripped, it was determined that reliable resetting of the trip solenoid, i.e., restoring plunger 130*a* to its fully seated, retracted position, should be carried out while the breaker is tripping open, not while its operating mechanism is being recharged. To this end, the opening motion of the movable contact assemblies is utilized to reset the trip solenoid. Thus, a pin 132 is mounted atop crossbar 28*a* above the center pole movable contact assembly, as also seen in FIG. 1. As will be described in conjunction with FIGS. 6 and 7, this pin acts on a flux shifter reset and trip lever assembly, generally indicated at 134, as the movable contact assemblies spring to their tripped open position.

This assembly includes a reset lever 135 which is mounted to the mechanism frame by a pin 136 for pivotal movement limited by a headed guide pin 137 operating in an elongated slot 135*a* in the reset lever. The reset lever, in turn, mounts an actuating arm 138 pivoted at its left end on pin 138*a*. The other end of this arm carries a pin 138*b* which operates in an elongated slot 135*b* in reset lever 135. A dependage 135*c* of the reset lever serves as an anchorage for one end of a tension spring 140, whose other end is hooked on actuator arm pin 138*b*. Thus this spring biases pin 138*b* to the bottom end of slot 135*b*, thereby establishing a normal angular relationship between the reset lever and actuator arm.

The reset lever carries an upstanding finger 135*d*, which, in FIG. 5, is seen to be poised in closely spaced relation to the head of plunger 130*a* in its phantom line extended position. Also included in the assembly 134 is a trip lever 142, which is mounted to the mechanism frame by a pin 143 for pivotal movement limited by a stationary pin 144 received in an elongated slot 142*a* formed in the trip lever. A torsion spring 145, carried by pin 143, biases the trip lever to a clockwise-most position determined by the bottoming of pin 144 against the upper end of slot 142*a*. The trip lever, in turn, carries a pin 146 serving to pivotally mount the upper end of a latch element 148. A pin 148*a*, carried by this latch element, projects transversely through an elongated slot 142*b* in the trip lever to limit the extent of pivotal movement of the latch element. A tension spring 149 biases the latch element to clockwise-most position relative to the trip lever, as determined by the engagement of pin 148*a* against the left end of slot 142*b*. The upper end of the trip lever carries a horizontally protruding nose 142*c* which, with the trip lever in its clockwise-most position imposed by spring 145, is poised in closely spaced relation to actuating arm 78*b* of secondary latch 78 in its solid line latching position. Latch element 148 is provided with a latch shoulder 148*b* normally disposed to be engaged by a latch pin 135*e* carried by reset lever 135. Finally, a tension spring 150, hooked at its lower end to a dependage 142*d* of the trip lever and at its upper end to reset lever 135, bias the reset lever to its clockwise-most position determined by the bottoming of pin 137 against the upper end of reset lever slot 135*a*.

When a trip function is called for, the trip solenoid is actuated, and its plunger springs downward to its phantom line extended position, striking actuating arm 78*b* to pivot secondary latch 78 to its phantom line, unlatching position of FIG. 5 and thus tripping the breaker. As the movable contact assemblies swing to their tripped open position, pin 132 is moved along an arcuate path indicated at 151 in FIG. 6. Prior to the passage of the movable contact assemblies through their hooked open position en route to their tripped open position, pin 132 picks up actuator arm 138, camming it upwardly. Since spring 140 effectively serves to gang the reset lever and actuator arm together, these parts are swung upwardly as a unit about pivot pin 136 in response to the opening motion of the movable contact assemblies. Finger 135*d* of the reset lever is thus propelled generally upwardly to drive the trip solenoid plunger 130*a* back to its retracted, seated position. To ensure the requisite firm reseating of the plunger and to relax manufacturing tolerances, the plunger is fully reseated shortly before the movable contact assemblies pass through their hooked open position en route to their tripped open position. Thus the upward movement of the reset lever is bottomed out by the arrival of the plunger in its seated position before the full extent of the upward movement of the actuator arm 138 induced by the opening movement of the movable contact assemblies is achieved. This situation is tolerated by spring 140, which simply yields to accommodate an additional incremental upward movement of actuator arm 138 in pivoting about its pivot pin 138*a*. When the movable contact assemblies achieve their tripped open position, pin 132 is in its position indicated at 132*a* in FIG. 6 to hold the actuator arm 138 in its most elevated position with its pin 138*b* displaced from the bottom of reset arm slot 135*b*. Consequently, spring 140 exerts a considerable counterclockwise movement on reset arm 135, and its finger 135*d* imposes a strong, resilient force on the plunger to insure firm reseating thereof. Preferably, the geometry of the reset lever and actuating arm is such that when the movable contact assemblies spring back from their tripped open position to their hooked open position where pin 132 assumes the position indicated at 132*b*, the most elevated position of the actuator arm is left essentially undisturbed. Thus, the plunger is held firmly, but resiliently reseated while the movable contact assemblies are in their hooked open position awaiting reclosure. This feature is deemed quite desirable since the movable contact assemblies are typically in their tripped open position for only a brief interval of time which may be insufficient to insure reliable reseating of the plunger.

It will be observed in FIG. 1 that, with the movable contact assemblies in their phantom line, closed circuit position, toggle links 24 and 26 do not achieve an overcentered condition or even a fully straightened condition, but in fact are slightly collapsed to the left. Under these circumstances, the movable contact assemblies can be readily blown open in the face of a high level fault current. In such event, the toggle is immediately forced to collapse leftwardly as the mechanism springs 32 elongate; the cradle having yet to be unlatched from its reset position. From FIG. 6, it is seen that the induced elevation of reset lever 135 as the movable contact assemblies are blown open could prevent plunger 130*a* from striking secondary latch 78 to trip the breaker when the trip solenoid is subsequently activated by the static trip unit acting in response to the high fault current wave. If secondary latch 78 is not removed forthwith to permit the tripped movable contact operating mechanism to immediately catch up with the fault current induced opening movement of the movable contact assemblies, the mechanism springs will drive the movable contact assemblies back to their close circuit position of the approach of a current zero. Understandably, such spurious reclosure of the breaker contacts in the face of a high level fault current is a highly undesirable situation.

To remedy this situation, trip lever 142 is utilized to remove secondary latch 78 incident to the movable contact assemblies being blown open. To this end, as reset lever 135 and actuator arm 138 are being propelled upwardly as a unit by pin 132 incident to the movable contact assemblies being blown open, latch pin 135*e* is swung upwardly to pick up latch shoulder 148*b* of latch element 148, as seen in FIG. 5. The line of force of this engagement is to the left of the latch element pivot pin 146, and thus the upward movement of the reset lever is communicated to trip lever 142, causing the latter to be pivoted in the counterclockwise direction about its pivot pin 143 against the bias of torsion spring 145. Noise 142*c* is thus propelled into engagement with actuating arm 78*b* to swing secondary latch 78 to its unlatching position and trip the circuit breaker. The movable contact operating mechanism is thus immediately unlatched to catch up with the blown open movable contact assemblies and prevent spurious detrimental reclosure thereof.

Figure 7:
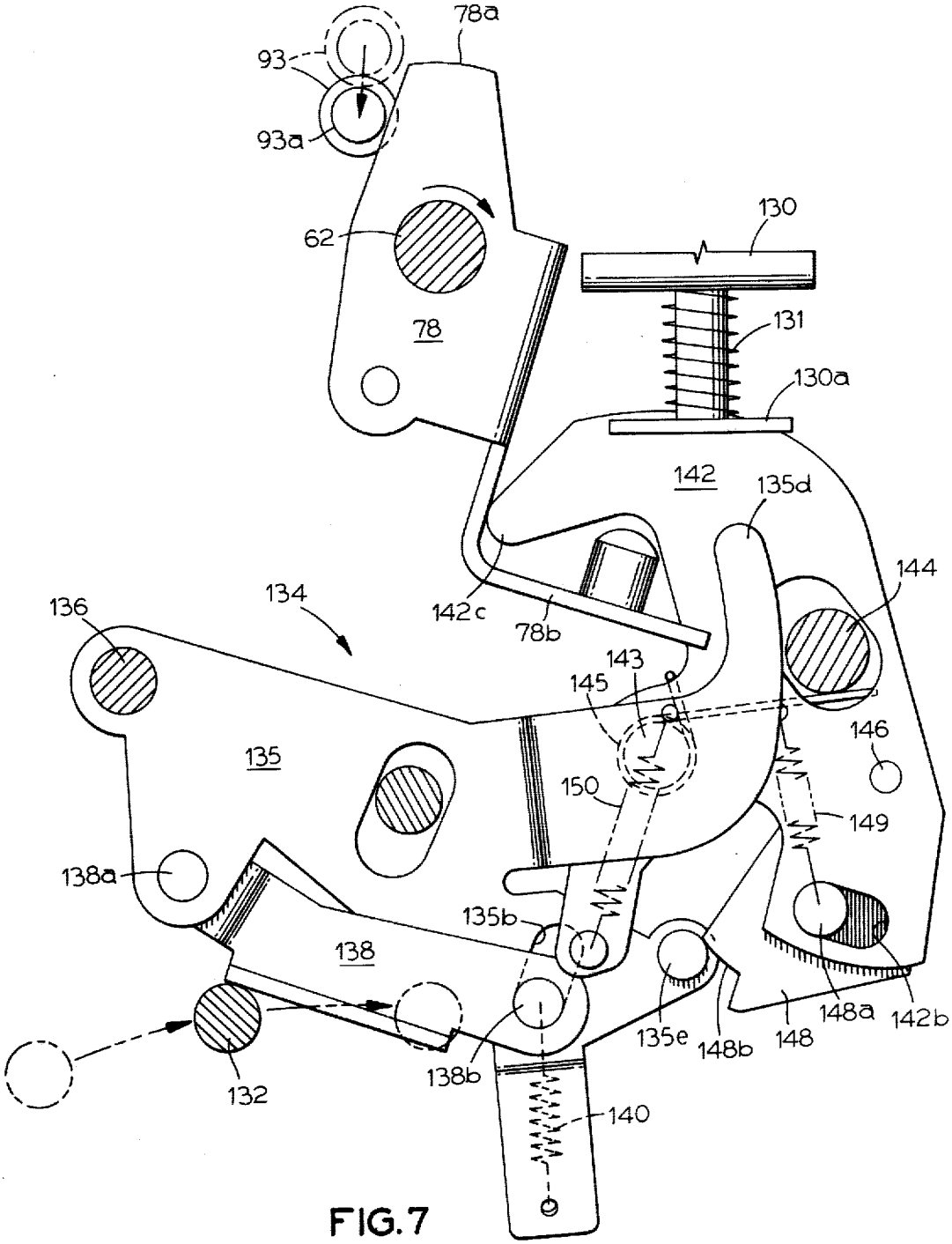
FIG. 7 is a side elevational view of the reset assembly of FIG. 5 as seen in its condition effective tripping of the circuit breaker in response to the movable contacts being blown open by a high level fault current.

Once the trip lever has accomplished its tripping function, which, as seen in FIG. 7 is before significant elevation of reset lever finger 135*d* has occurred, latch pin 135*e* rides to the edge of latch shoulder 148*b*. With continuing upward movement of the reset lever, the latch pin engagement with the latch element creates a line of force thereon lying below the axis of its pivot pin 146. Consequently, the latch element is pivoted in the counterclockwise direction, clearing the latch pin and the trip lever snaps back to its normal, clockwise-most position under the urgence of torsion spring 145.

When the movable contact assemblies are subsequently returned to their closed circuit position, pin 132 swings out of the way of reset and trip lever assembly 134 permitting springs 140 and 150 (FIG. 7) to bias the reset lever and actuator arm to their normal, downward positions. As the reset lever drops down, its pin 135*e* simply kicks latch element 148 out of the way. It will be appreciated that the tripping action of the trip lever occurs each time the movable contact assemblies swing to their tripped open position. However, except when they are blown open, secondary latch 78 will already have been removed, rendering the trip lever tripping action superfluous.

It will thus be seen that the objects set forth above, among those made apparent in the preceding description, are efficiently attained and, since certain changes may be made in the above construction without departing from the scope of the invention, it is intended that all matter contained in the above description or shown in the accompanying drawings shall be interpreted as illustrative and not in a limiting sense.

Having described our invention, what we claim as new and desire to secure by Letters Patent is:

1. A flux shifter reset assembly for reliably reseating the plunger of a flux shifter-type trip solenoid from its circuit breaker trip initiating extended position, said assembly comprising, in combination:

A. an activating element mounted for movement with the breaker movable contact assemblies between first, second and third positions as the movable contact assemblies swing between closed, hooked open and tripped open positions, respectively;

B. a reset lever mounted for pivotal movement between a de-actuated position and an actuating position, said reset lever including a projection disposed to engageably restore the trip solenoid plunger from its extended position to its reseated position as said reset lever is propelled from its de-actuated position to its actuated position;

C. an elongated actuating arm pivotally mounted adjacent one end to said reset lever; and D. means resiliently driving coupling the other end of said actuating arm to said reset lever, with said reset lever in its de-actuated position, said actuating arm disposed to be engaged by said activating element as it moves from its first position toward its second position such as to rotate said reset lever and actuating arm as a unit about the reset arm pivotally mounting, said reset lever achieving its fully actuated position to reseat the trip solenoid plunger prior to the arrival of said activating element at its second position, with movement of said activating element on to its third position, said drive coupling means simultaneously yielding to accommodate overtravel pivotal movement of said actuating arm about its pivotal mounting with said reset lever and applying a resilient force holding said reset lever in its actuated position.

2. The flux shifter reset assembly defined in claim 1, wherein said resilient drive coupling means is in the form of a lost motion coupling and a spring acting to take up the lost motion therein.

3. The flux shifter reset assembly defined in claim 1, wherein said resilient drive coupling means comprises a pin mounted by said other end of actuating arm and received in an elongated slot formed in said reset lever, and a tension spring acting between said pin and said reset lever to normally maintain said pin bottomed against one end of said slot, said spring yielding to accommodate movement of said pin through said slot during said actuating arm overtravel.

4. The flux shifter reset assembly defined in claim 1, wherein said actuating arm is structured such that its angular relationship with said reset lever is essentially undisturbed by the movement of said activating element between its second and third positions.

5. The flux shifter reset assembly defined in claim 4, wherein said resilient drive coupling means comprises a pin mounted by said other end of actuating arm and received in an elongated slot formed in said reset lever, and a tension spring acting between said pin and said reset lever to normally maintain said pin bottomed against one end of said slot, said spring yielding to accommodate movement of said pin through said slot during said actuating arm overtravel.

6. The flux shifter reset assembly defined in claim 1, which further includes a trip lever mounted for pivotal movement between a quiescent position and a tripping position in circuit breaker trip initiating engagement with a latch element of a trip latch assembly, said trip lever being picked up and rotated from its quiescent position to its tripping position by said reset lever during movement thereof from its de-actuated position toward its actuated position in response to movement of said activating element from its first position toward its second position.

7. The flux shifter reset assembly defined in claim 6, which further includes means biasing said trip lever to its quiescent position, and co-acting means carried by said reset lever and said trip lever for providing driving engagement therebetween during initial movement of said reset lever toward its actuated position sufficient to propel said trip lever from its quiescent position to its tripping position, whereupon said co-acting means drivingly disengages to permit the return of said trip lever to its quiescent position by said biasing means before said reset lever achieves its actuated position.

8. The flux shifter reset system defined in claim 7, wherein said co-acting means includes a spring biased latch member pivotally mounted by said trip lever and a latch pin carried by said reset lever for engagement with a latch shoulder formed in said latch member to achieve driving engagement therebetween, upon the arrival of said trip lever at its tripping position, the line of force of said latch pin exerted on said latch member being effective to pivot said latch member against its spring bias in an unlatching direction to disengage said latch shoulder from said latch pin, said latch member being cammed in said unlatching direction by said latch pin to accommodate the return of said reset lever to its de-actuated position when said actuating element moves to its first position.

9. The flux shifter reset system defined in claim 7, wherein said resilient drive coupling means comprises a pin mounted by said other end of actuating arm and received in an elongated slot formed in said reset lever, and a tension spring acting between said pin and said reset lever to normally maintain said pin bottomed against one end of said slot, said spring yielding to accommodate movement of said pin through said slot during said actuating arm overtravel.

10. The flux shifter reset assembly defined in claim 9, wherein said actuating arm is structured such that its angular relationship with said reset lever is essentialy undisturbed by the movement of said activating element between its second and third positions.

* * * * *